United States Patent [19]

Alpert

[11] 4,128,398

[45] Dec. 5, 1978

[54] PROCESSING AID FOR USE IN WORSTED AND WOOLEN PROCESSES

[75] Inventor: Mel Alpert, Morristown, N.J.

[73] Assignee: Diamond Shamrock Corporation, Cleveland, Ohio

[21] Appl. No.: 656,289

[22] Filed: Feb. 9, 1976

Related U.S. Application Data

[63] Continuation of Ser. No. 451,909, Mar. 18, 1974, abandoned.

[51] Int. Cl.[2] ..... D06M 13/20; D06M 13/34; D06C 7/04

[52] U.S. Cl. ..... 8/127.6; 8/128 A; 8/128 R; 8/139; 8/140; 8/DIG. 8

[58] Field of Search ..... 8/DIG. 8, 128 R, 128 A, 8/139, 140, 115.6, 127.6

[56] References Cited

U.S. PATENT DOCUMENTS

| | | | |
|---|---|---|---|
| 3,049,445 | 8/1962 | Lundgren et al. | 260/29.2 EP |
| 3,128,145 | 4/1964 | Redston | 8/140 |
| 3,647,763 | 3/1972 | Stockmann | 260/78 SC |
| 3,793,279 | 2/1974 | Lipowski | 260/29.2 EP |

OTHER PUBLICATIONS

The Modern Textile Dictionary, G. E. Linton, pp. 137 & 1054.

Graft Photo Polymerization of Acrylic Monomers onto Wool Sensitized by Anthroquinones, Needles et al., Applied Polymer Symposium, No. 18, pp. 569–577, (1971).

Wool Fabric Stabilization by Interfacial Polymerization: Pt. I Polyamides Whitfield et al., Textile Research Journal, (Aug. 61), pp. 704–711.

Wool Stabilization With Polyurea Finishes, Whitfield, Applied Polymer Symposium, No. 18, pp. 559–560 (1971).

Recent Developments in the Carbonization of Loose Wool and Noil, Motlova, Applied Polymer Symposium, No. 18, pp. 1163–1164 (1971).

Production and Properties of Wool With Incorporated Polymers, W. S. Simpson, Applied Polymer Symposium, No. 18, 585, 586, 592.

*Primary Examiner*—John Kight, III

*Attorney, Agent, or Firm*—Neal T. Levin; Leslie G. Nunn

[57] ABSTRACT

A processing aid is used to improve worsted and woolen processes. In the worsted process, pretreatment of wool tops with the processing aid prior to dyeing preserves fiber strength and softness. In the woolen process, addition of the processing aid to the carbonizing bath permits reduction in sulfuric acid concentration, enhances destruction of vegetable matter, and produces whiter, cleaner fiber and preserves fiber strength. If desired, the processing aid may also be introduced in the final rinse after wool scouring in either worsted or woolen processes. The preferred processing agent is epoxidized chain extended polyamide.

32 Claims, No Drawings

PROCESSING AID FOR USE IN WORSTED AND WOOLEN PROCESSES

This is a continuation of application Ser. No. 451,909, filed Mar. 18, 1974, now abandoned.

BACKGROUND OF THE INVENTION

1. Field of the Invention

This invention relates to worsted and woolen processes and more particularly to use of a processing aid in these processes to preserve fiber strength.

2. Description of the Prior Art

In both worsted and woolen processes, wool fibers are exposed to acid and heat. In the worsted process, wool tops are dyed using acid dye baths at elevated temperatures. In woolen processes, wool fibers are carbonized to destroy vegetable matter by heating wool fiber containing dilute acid. Apart from the losses of wool by handling in these processes, acid and heat wave adverse effects on the physical and chemical properties of wool fibers and yarns and cause considerable damage. Under these conditions, measurable losses of wool substance can be attributed to protein hydrolysis.

There is a definite need to minimize the adverse effects caused by acid and heat in worsted and woolen processes.

STATEMENT OF THE INVENTION

Pretreatment of wool tops in the worsted process with a processing aid prior to dyeing preserves fiber strength and softness. Addition of the processing aid in the woolen process to the carbonizing bath permits reduction in sulfuric acid concentration, enhances destruction of vegetable matter, and produces whiter, cleaner fiber and preserves fiber strength. If desired, the processing aid may also be introduced in the final rinse after wool scouring in the worsted or woolen process. Useful processing agents include (1) polyamide
(2) epoxidized polyamide
(3) chain extended polyamide
(4) expoxidized chain extended polyamide
(5) expodized polyamine
(6) epoxidized polyalkylenimine
(7) polyacrylamide
(8) polyacrylic acid
(9) aminoplast resin
(10) oligomer of urea, a polyamine and an alkylene dihalide, and
(11) reaction product of acrylamide, diallyldimethyl ammonium chloride and glyoxal.

DESCRIPTION OF THE PREFERRED EMBODIMENTS

In the worsted process, wool tops are pretreated with the processing aid prior to dyeing in the tops dyeing step to preserve strength of the fiber and yarn. The wool tops are pretreated with an amount of the processing aid sufficient to preserve fiber strength and softness. The wool tops are in the form of packages of cross wound sliver on perforated spindles. The packages of sliver are about 16 inches in height and 14 inches in diameter. Sufficient aqueous solution or dispersion of the processing aid is circulated through the perforated spindle and through the package to obtain the desired pickup. After pretreatment, the tops are dyed by pumping the dye liquor through the perforated spindle. If desired the processing aid may also be introduced in the final rinse in the rinsing step following raw wool scouring. When the processing aid is introduced in the final rinse, the quantity of processing aid used in the pretreatment prior to dyeing may be reduced proportionately. The quantity of processing aid used in the worsted process may vary from about 0.2 to about 1.5% (solids owf), with the preferred amount being about 1.0% (solids owf), in the pretreatment prior to dyeing and from about 0.2 to about 1.5% (solids owf), with the preferred amount being about 1.0% (solids owf), in the final rinse. In the worsted process, if 1% of the processing aid is added in the final rinse in the raw wool scour, it is necessary to add about 0.2% of the processing aid (solids owf) as a low temperature pretreatment prior to addition of the dye in the tops dyeing step.

The following flow diagram for a conventional worsted process shows the points at which the processing aid is introduced.

| WORSTED PROCESS | |
|---|---|
| Raw Wool Scouring | |
| Rinsing | - (optional) add about 1% processing aid (owf solids) in final rinse |
| Drying | |
| Blending | |
| Carding | |
| 1st Gilling | |
| 2nd Gilling | |
| 3rd Gilling | |
| Combing (tops) | |
| Backwashing | |
| Gilling (tops) | |
| Finisher Gilling (tops) | |
| Top Dyeing | - add about 1% processing aid (solids owf) as a pretreatment at beginning of dye cycle |
| Backwashing | |
| Gill Mixing | |
| Recombing | |
| First Auto Leveler Gill | |
| First Intersector Pin Drafter | |
| Second Intersector Pin Drafter | |
| Roving Frame | |
| Spinning | |
| Twisting | |
| Knitting or Weaving | |

The following advantages are noted when about 1% of the processing aid (solids owf) is introduced in the final rinse after scouring in a conventional worsted process:

1. Provides more uniform application than when introduced in top dyeing. This is because there are over 100 blendings in the preparation of tops before dyeing.
2. Saves approximately 40 minutes in the pretreatment process before top dyeing as the pretreatment process can be carried out at 40° C instead of raising to the boil as is necessary if the processing aid is not previously applied. This allows the total dyeing cycle to be reduced to half the time normally required for a chrome dyeing and preserves fiber strength as well as softness.
3. Produces tops with greater bulk (less density) yielding better dye liquor flow and more even dyeing throughout the package.

The following advantages are noted when 1% of the processing aid (solids owf) is introduced as a pretreatment in tops dyeing:

1. Accelerates dyeing rate and reduces acid usage — requires 25–50% less time — 60% less time to boil — 50% less acid.

2. Provides 10% greater dyestuff yield.
3. Preserves fiber strength and softness.
4. Since many mills buy tops ready for dyeing, they must apply the processing aid as a pretreatment in tops dyeing.

In the woolen process, the processing aid is added to the final rinse after raw wool scouring or to the carbonizing bath or to both to preserve fiber and yarn strength. Use of the processing aid in the final rinse or carbonizing bath permits reduction in sulfuric acid concentration and enhances destruction of vegetable matter in the wool. If desired the processing aid may also be introduced in the final rinse in the rinsing step following raw wool scouring. When the processing aid is introduced in the final rinse, the quantity of processing aid added to the carbonizing bath may be eliminated or reduced proportionately. The quantity of processing aid used in the woolen process may vary from about 0.2 to about 1.5% (solids owf), with the preferred amount being about 1.0% (solids owf), in the carbonizing bath and from about 0.2 to about 1.5% (solids owf), with the preferred amount being about 1.0% (solids owf), in the final rinse.

The following flow diagram for a conventional woolen process shows the points at which the processing aid may be introduced.

| WOOLEN PROCESS | |
|---|---|
| Raw Wool Scouring | |
| Rinsing | - (optional) add about 1% processing aid (solids owf) product in final rinse |
| Drying | |
| Carbonizing | - (optional) add about 1% processing aid (solids owf) product in carbonizing bath |
| Drying | |
| Neutralizing Wash | |
| Rinse | |
| Drying | |
| Blending | |
| Carding | |
| Spinning | |
| Twisting | |
| Weaving or Knitting | |
| Dyeing | |

The following advantages are noted when about 1% of the processing aid (solids owf) is introduced in the final rinse after scouring in a conventional woolen process:

1. Addition of the processing aid in the final rinse provides more complete pickup of processing aid because it is applied before the fiber is attacked by acid.
2. Provides more uniform pickup of processing aid before carbonizing.
3. Stock is in a more open condition than in carbonizing bath.
4. Application in final rinse results in greater shake out of dirt and vegetable matter at first drying which follows the rinse.
5. Fiber is better protected when later carbonized.
6. Application in rinse after scouring permits acid concentration of carbonizing bath to be reduced yielding whiter stronger fiber.

The following advantages are noted when about 1% of the processing aid (solids owf) is added to the carbonizing bath:

1. Addition to carbonizing bath provides better wetting and destruction of the vegetable matter.
2. Application to carbonizing bath permits acid concentration of the carbonizing bath to be reduced by 25% yielding whiter fiber with better preservation of fiber strength and fiber containing less vegetable matter and cleaner than obtained in conventional operations.
3. Since some mills receive wool in a prescoured condition, they must apply the processing aid to the carbonizing bath. Useful processing aids for both processes include (1) polyamides prepared by the reaction of polycarboxylic acids such as
(a) saturated dicarboxylic acids having 4 to 12 carbon atoms;
(b) non-decarboxylating unsaturated dicarboxylic acids having from 5 to 12 carbon atoms;
(c) saturated and non-decarboxylating unsaturated tricarboxylic acids having 6 to 10 carbon atoms;
(d) $C_{1-12}$ alkyl mono- and di-esters of saturated and unsaturated dicarboxylic acids having 2 to 12 carbon atoms;
(e) $C_{1-12}$ alkyl mono- and di-esters of saturated and unsaturated tricarboxylic acids having 6 to 10 carbon atoms; and
(f) anhydrides of saturated and unsaturated dicarboxylic acids having 4 or 5 carbon atoms;

with a polyamine having at least two primary amino groups and at least one secondary or tertiary amino group such as prim, sec-diethylenetriamine; prim, sec-tetraethylenepentamine; prim, tert-bis(aminopropyl) methylamine; prim, sec-pentaethylenehexamine, and prim, sec-triethylenetetramine.

Specific acids, esters and anhydrides which may be used in the preparation of the above polyamides are: diethyloxalate, diethylmalonate, succinic acid, succinic anhydride, diethylsuccinate, monomethyl succinate, maleic anhydride, D,L-malic acid, glutaric acid, glutaric anhydride, dimethylglutarate, itaconic acid, adipic acid, monomethyl adipate.

Typical polyamides prepared with the above reactants include the polyamide obtained by reaction of diethylenetriamine and adipic acid, the polyamide obtained by reaction of methyl glutarate and pentaethylenehexamethylene and the polyamide obtained by reaction of succinic acid and tetraethylene pentamine.

The disclosure as to the above polyamides and their preparation as described in U.S. Pat. No. 2,926,154 - Keim - dated Feb. 23, 1960, U.S. Pat. No. 2,961,347 - Floyd - dated Nov. 22, 1960 and Patent application U.S. Ser. No. 304,729 - Lipowski - filed Nov. 8, 1972 now U.S. Pat. No. 3,793,279, patented Feb. 19, 1974 are incorporated by reference herein.

(2) epoxidized polyamides may be prepared by reacting one or more of the polyamides described in (1) above with an epoxidizing agent such as an epihalohydrin or an alkyl substituted epihalohydrin. Typical epoxidizing agents include epichlorohydrin, epibromohydrin, epiiodohydrin, bromoepoxybutane, and chloroepoxyhexane.

Useful epoxidized polyamides include the epoxidized polyamide obtained by reacting epichlorohydrin with a polyamide from adipic acid and diethylenetriamine, the epoxidized polyamide obtained by reacting dichlorohydrin with a polyamide from succinic acid and tetraethylenepentamine. The disclosure as to the expoxidized polyamides described in U.S. Pat. No. 2,926,154 — Keim — dated Feb. 23, 1960 and U.S. Pat. No. 2,961,347 — Floyd — dated Nov. 22, 1960 are incorporated by reference herein.

(3) chain extended polyamides may be prepared by reacting one or more of the polycarboxylic acids and one or more of the polyamines described in (1) above at a ratio of 0.66 to about 0.99 mole of polyamine per mole of polycarboxylic acid to obtain a polyamide having free carboxylic acid groups and then reacting the polyamide with a terminating amine in an amount at least sufficient to react with all free carboxylic acid groups in the polyamide to form an amino terminated polyamide and then reacting the amino terminated polyamide with a chain extender to obtain the desired chain extended polyamide. Examples of chain extended polyamides include the chain extended polyamide formed by reaction of one mole of adipic acid with 0.95 mole of diethylenetriamine and terminated by reaction with dimethylaminopropylamine and then chain extended by reaction with 1.34 mole dichloroethyl ether per reactive amino group present in the amino terminated polyamide, the chain extended polyamide prepared by reaction of one mole of dimethyl glutarate with 0.90 mole of diethylenetriamine terminated with dimethylaminopropylamine and then chain extended with methylenedibromide, the chain extended polyamide prepared from one mole of adipic acid and 0.60 moles of pentaethylenehexamine, terminated with dimethylaminopropylamine and then chain extended with dichloroethylether. Other useful chain extenders include methylenedibromide; ethylenedibromide; methylenediiodide; dichloroethylether; dichloroisopropylether; and triglycoldichloride.

The disclosure as to the above chain extended polyamides and their preparation as described in Patent Application U.S. Ser. No. 304,729 - Lipowski - filed Nov. 8, 1972, now U.S. Pat. No. 3,793,279, patented Feb. 19, 1974 are incorporated herein by reference.

(4) epoxidized chain extended polyamides may be prepared by reacting one or more of the chain extended polyamides described in (3) above with an epoxidizing agent such as an epihalohydrin or an alkyl substituted epihalohydrin. Typical epoxidizing agents include epichlorohydrin, epibromohydrin, epiiodohydrin, bromoepoxybutane, and chloroepoxyhexane.

Useful epoxidized chain extended polyamides include the epoxidized chain extended polyamide formed by reaction of one mole of adipic acid with 0.95 mole of diethylenetriamine, terminated by reaction with dimethylaminopropylamine, chain extended by reaction with 1.34 mole dichloroethyl ether per reactive amino group present in the amino terminated polyamide and then reacted with epichlorohydrin, the epoxidized chain extended polyamide prepared by reaction of one mole of dimethyl glutarate with 0.90 mole of diethylenetriamine terminated with dimethylaminopropylamine, chain extended with methylenedibromide and then reacted with epibromohydrin, the epoxidized chain extended polyamide prepared from one mole of adipic acid and 0.60 mole of pentaethylenehexamine, terminated with dimethylaminopropylamine, chain extended with dichloroethylether and then reacted with epichlorohydrin.

The disclosure as to the above epoxidized chain extended polyamides and their preparation as described in Patent Application U.S. Ser. No. 304,729 — Lipowski — filed Nov. 8, 1972 now U.S. Pat. No. 3,793,279, patented Feb. 19, 1974 are incorporated herein by reference.

(5) epoxidized polyamines include reaction products of polyalkyleneamines and epoxidizing agents such as the reaction product of diethylenetriamine and epichlorohydrin, the reaction product of pentaethylenehexamine and epibromohydrin, the reaction product of tetraethylene-pentamine and chloroepoxyhexane, the reaction product of bishexamethylenetriamine and epichlorohydrin. The disclosures as to these epoxidized polyamines and their preparation described in U.S. Pat. No. 2,595,935 — Daniels, Jr., et al. dated May 6, 1952 are incorporated by reference herein.

(6) epoxidized polyalkylenimines include the reaction products of epoxidizing agents with alkylenimine polymers such as the reaction products of epichlorohydrin with polyethylenimines having molecular weights from 50,000 to 200,000. These products also include the reaction products of the polyalkylenimine homologs of ethylenimines with epoxidizing agents such as epichlorohydrin, epibromohydrin, epiiodohydrin, bromoepoxybutane, and chloroepoxyhexane. The disclosures as to these epoxidized polyalkylenimines and their preparation as described in U.S. Pat. No. 3,520,774 — Roth — dated July 14, 1970 are incorporated by reference herein.

(7) polyacrylamides include polyacrylamide agents having molecular weights of from about one million to about two million. A 5% solution of a typical polyacrylamide resin having a Brookfield viscosity of 8,000 cps at 25° C may be used. Polyacrylamide resins are well known in the polymer art and their preparation has been the subject of numerous publications and patents.

(8) polyacrylic acids include polyacrylic acids as well as their water soluble salts. A 40% by weight solution of a sodium polyacrylate resin having a Brookfield viscosity of 2500–3000 cps may be used. Polyacrylic acids and their water soluble salts are well known in the polymer art. Numerous publications and patents describing their properties and preparation may be found in the literature.

(9) aminoplast resins include aminoplast resins obtained by the reaction of dicyandiamide, urea and formaldehyde. The aminoplast resin prepared by the condensation of one mole of dicyandiamide, 0.5 mole of urea, and 2.8 moles of formaldehyde may be used. The preparation of this resin is described in Example I of U.S. Pat. No. 2,990,397 — Fetscher and Lipowski — granted June 27, 1961. The disclosure as to this type of aminoplast resins and their preparation as described in the above-mentioned patent are incorporated by reference herein.

(10) reaction products of urea, a polyamine and an alkylene dihalide or dihalide ether such as the reaction product of one mole of dimethylaminopropylamine, 0.5 mole of urea and 0.5 mole of dichloroethylether as described in Example V of U.S. Pat. No. 3,734,889 — Lipowski and Miskel, Jr. — granted May 22, 1973. The disclosure of this patent as it applies to oligomers based on ureas, guanidine and guanylurea are incorporated by reference herein.

(11) reaction product of acrylamide, diallyldimethyl ammonium chloride and glyoxal include Parez 630-NC (American Cyanamid Co., Wayne, N.J.).

For a fuller understanding of the nature and objects of this invention, reference may be made to the following examples. These examples are given merely to illustrate the invention and are not to be construed in a limiting sense. All parts, proportions and quantities are by weight unless otherwise indicated. The terms g, l, °

C, ° F, hr, in, are used to indicate grams, liters, degrees Centigrade, degrees Fahrenheit, hours, inches respectively, in these examples.

EXAMPLE 1

This example demonstrates use of a processing aid as a pretreatment at the beginning of the tops dyeing cycle in a worsted process to achieve identical levels of exhaustion, yield of color, and color fastness while preserving better, wool fiber strength and working properties.

A mill trial was started at the dye house utilizing worsted carded 100% wool tops. The size of both lots, the trial lot and the control lot, was 1000 pounds each.

| Specifications for the 100% wool tops used |
|---|
| Length of fiber - 60.1 ± 5.9 mm |
| Coefficient of variation - 43 ± 3.2 |
| Percent of short fiber - (maximum 36 mm length) 15.6 ± 7.6 |
| Fineness - 21.6 ± 3 micron |
| Number of large neps per kilo - 3.1 ± 2 |
| Number of small neps per kilo - 786 ± 173 |
| Number of large straws per kilo - 25.4 ± 16 |
| Number of small straws per kilo - 127 ± 33 |
| Number of loose slubs per kilo - 10.9 ± 3.7 |
| Percent fatty matter - 0.27 ± 0.15 owf |

Dyeing Procedure

Each 1000 pound lot was dyed according to the following procedure in a pressure stainless dyeing unit:

A. Scouring

Tops were secured for 30 minutes at 50° C with one gram per liter of a nonionic surfactant (nonyl phenol condensed with about 10 moles of ethylene oxide) plus ⅓ gram/liter ammonium hydroxide. This was followed by two cold rinses.

B. Pretreatment of Trial Lot with Processing Aid

Bath ratio 10 to 1.

Processing aid used: 1% solids owf of the epoxidized chain extended polyamide prepared and described in Example 22 in Ser. No. 304,729 — Lipowski — filed Nov. 8, 1972, now U.S. Pat. No. 3,793,279, patented Feb. 19, 1974 the disclosure in this example relating to this polyamide and its preparation are incorporated by reference herein, plus 0.15% nonionic surfactant (nonyl phenyl condensed with about 10 moles of ethylene oxide).

Circulated for 5 minutes at 40° C, pH 6.0.

Raised to boil in 28 minutes.

Held at 100° C for 5 minutes. Dropped bath.

C. Dyeing

The trial lot dye bath is different from the control lot.

Trial lot dyeing was begun with dye bath set with 0.15% of nonionic surfactant (nonyl phenol condensed with about 10 moles of ethylene oxide) owf, at 40° C, pH 7. The control lot dyeing dyebath was set with 0.15% of the same nonionic surfactant, 3% sodium sulfate and 0.3% ammonium acetate at 40° C, pH 7.

Dyestuff used in trial lot was 3.6% Fenechrome Black T 200% (Mordant Black 11 — Color Index 14645) and in control lot was 4.0% Fenechrome Black T 200%.

(Trial Lot)

Ran 10 minutes at 40° C, pH 6.5 while adding dye.

Ran 5 minutes at 40° C after adding 0.2% acetic acid.

Ran 5 minutes at 40° C after second addition of 0.2% acetic acid.

Ran 5 minutes at 40° C with addition of 0.2, fornic acid, pH 5.

Raised temperature to 70° C in 15 minutes.

After 8 minutes at 70° C, the dyebath was completely exhausted.

Added 0.1% formic acid and 1.5% potassium dichromate at 70° C and raised to 102° C in 12 minutes.

Held bath at 102° C for 10 minutes — dropped bath.

Total elapsed (pretreatment time plus dyeing) time for the trial lot was 105 minutes.

(Control Lot)

1. Set dyebath at 40° C with
0.15% nonionic surfactant (nonyl phenyl condensed with about 10 moles of ethylene oxide)
3.0% sodium sulfate
0.3% ammonium acetate
Ran bath 5 minutes
2. Added 4.0% Fenechrome Black T 200% Ran bath for 5 minutes
3. Raised bath to 60° C in 15 minutes and added 0.4% acetic acid
4. Continued heating to raise bath to 70° C in 15 minutes and added 0.4% acetic acid
5. Continued heating to raise to 90° C in 15 minutes and added 0.4% acetic acid
6. Raised to 100° C in 15 minutes, held at 100° C for an additional 10 minutes
7. Added 1% formic acid, raised to 102° C for 10 minutes to exhaust bath
8. Cooled down to 80° C by running without steam in 25 minutes
9. Added 1.5% potassium dichromate and raised bath to 102° C in 25 minutes
10. Held bath at 102° C for 15 minutes
11. Dropped bath and rinsed tops Total elapsed time for control lot was 155 minutes.

With both the trial and control dyeing the speeds through the back washer were 2.4 meters per minute; temperatures of the dryers were 80° C and production rates were 80 kilograms per hour.

After back washing, both lots of tops were checked to determine the increase in yarn faults caused by the dyeing process. These checks were made on 25 meters of slivers and reported as faults per kilogram.

| | Trial Dyeing | Control Dyeing |
|---|---|---|
| Number of Neps per kilogram | 11.5 | 16.9 |
| Number of Loose Slubs per kilogram | 17.9 | 27.6 |
| % Fatty matter (determine by rapid extraction with petroleum ether) | 0.35% owf | 0.14% owf |

Comb Blending

Both lots were lubricated with 0.6% owf of a worsted oil lubricant and received one gill mixing. After this gill mixing, the trial lot showed a uster variation of 3.4 with an irregularity index of 8.65 while the control showed a uster variation of 4.1 with an irregularity index of 10.3.

Drawing and Spinning

Temperature — 24° C

Moisture content - 62–65% rh (relative humidity)

The sequence of operations was: auto leveler gill, intersector pin drafter, rover and spinning frame. These operations are shown in Steps 1 through 4 below.

Observations

1. Dyeing time for the trial lot was 105 minutes versus 155 minutes for the control lot. This was made possible by changing established dye procedures for the trial lot as aforementioned.

2. It was observed that the rate of exhaustion was greatly accelerated when the 0.2% formic acid was added to the trial lot.

3. In the trial lot, the dye solution was added to the dyeing system over a 10 minute period.

4. It was found that the same shade was obtained on both the control lot and the trial lot dyeing, but dyestuff consumption for the control lot was 10% higher. This is due to better dye exhaustion in the trial system. (The control lot was dyed with additional 10% of dyestuff after it was determined earlier in previous dyeings that additional color was required to match the shade of dyeings carried out utilizing the processing aid).

5. In the dyeing of the control lot, consumption of acetic acid and formic acid was twice as much as used or was necessary the dyeing of the trial lot because pretreatment with the processing aid increases markedly the affinity of the wool fiber for dye.

Back Washing

The dyed tops were back washed in a standard back washing unit having three bowls. In the first bowl, one gram per liter of a nonionic surfactant and ⅛ gram per liter of ammonium hydroxide were used, temperature 45° C.

In the second bowl, the tops were rinsed at 40° C in plain water.

In the third bowl, the tops were rinsed at 30° C in plain water.

1. First Auto Leveler Gill

Both lots were run at 80 meters per minute. Weight of the sliver was 35 grains per meter and draft 10 to 1.

Both lots were sprayed with 4/10% solids owf, worsted oil plus antistat from a 10% solution.

It was observed that the trial lot processed better than the control because there were fewer stops.

2. Intersector Pin Drafter

Speed - 78 meters per minute. Weight of sliver - 15 grains per meter. Draft - 10 to 1. Trial lot processed well at normal speed. Control lot processed with difficulty: production rate was very slow and the machine was stopped many times.

3. Intersector Pin Drafter

Speed — 94 meters per minute.

Weight of sliver — 4.5 grains per meter. Draft — 10 to 1.

Trial lot processed well at normal speed but control lot processed with difficulty at very low production rate due to many stops.

4. Rover

Speed — 60 meters per minute.

Initially 10 trial bobbins plus 2 control bobbins were placed (simultaneously) on the rover. At the maximum speed of 60 meters per minute, it was necessary to discontinue processing of the control lot because too many end breaks occurred. On the other hand, the trial lot processed normally. The control lot was gilled again at the third intersector pin drafter. Even after gilling, the control lot could only be processed at a maximum speed of 55 meters per minute and at this speed with difficulty.

Efficiency at drawing: Waste collected from step 1 + 2 + 3 + 4 for trial lot was 1.7% and for control lot was 3.7%.

Note

Both lots were processed in a similar manner on the auto leveler and intersectors without optimizing working conditions on the machines to obtain comparative runs.

Uster values and the irregularity index of the sliver from both lots were:

1. Auto Leveler Gill Trial lot, uster 2.35 - irregularity index 6.4 Control lot, uster 2.9 - irregularity index 7.85

2. Intersector Pin Drafter Trial Lot - uster 2.8 - irregularity index 5.05 Control - uster 2.9 - irregularity index 5.2

3. Intersector Pin Drafter Trial - uster 3.6 - irregularity index - 3.52 Control - uster 5 - irregularity index - 4.95

4. Rover Trial Lot - uster 5.6 - irregularity index - 1.93 Control - uster 5 - irregularity index - 2.84

It was necessary for the control lot to be gilled twice at the third intersector pin drafter to bring the lot within the tolerances required for spinning. As a result of the second gilling, the uster value became 3.8 and the irregularity index 1.81.

Spinning Frame

Spinning frame conditions: temperature 25° C, relative humidity 80%. Yarn 1/32 count. Spindle speed 6,000 rpm; machine speed, 14 meters per minute.

At a speed of 14 meters per minute, the number of end breaks per 1,000 spindle hours for the trial lot were 402 and for the control lot were 800. Working speed was then lowered to 12.5 meters per minute and results improved. The number of end breaks per 1,000 spindle hours for trial lot were 246 and for the control lot were 384.

The following uster values for slivers and yarn were recorded:

For trial lot — sliver from rover, uster value 3.5 - irregularity index 2.48. Yarn uster value 17.5 — irregularity 1.45. For the control lot - sliver from rover uster value 7.2 — irregularity index 2.57. Yarn uster value 17.2 irregularity 1.43.

The following yarn properties were obtained: The values for yarn tensile strength in grams for the trial lot on the first, second, and third days were: 144, 150.4 and 152.4. The values for the control lot on the first day, second day, and third day were 125.6, 124.4 and 132. Hank tensile strength in kilograms for the trial lot over the three day period averaged 4.8. For the control lot the hank tensile strength average was 4.1. The elongation for production over the three day period for the trial lot was 5.6% and for the control lot 5.0%. The uster value over the three day period for the trial lot was 15.6 and for the control lot 16.7.

An analysis of end breaks in coning gave the following results:

| Per Kilo | Trial Lot | Control Lot |
|---|---|---|
| Number of end breaks originated by slubs | 108 | 259 |
| Number of end breaks originated by thin yarn places | 13 | 36 |
| Number of end breaks originated by thick places | 3 | 13 |

-continued

| Per Kilo | Trial Lot | Control Lot |
|---|---|---|
| Total number of end breaks | 124 | 308 |

Conclusions

1. The trial lot pretreated with the processing aid prior to dyeing black with chrome showed a 28% shorter dyeing cycle, 50% less acid consumption, 10% higher dyestuff yield, less steam consumption, 11% improvement in spinning production, and 28% improvement in dyeing production.

2. Fewer neps in the dyed tops for the trial lot.

3. Better sliver processing in the drawing department with less waste and higher production rates for the trial lot.

4. The number of end breaks at the spinning frame for the trial lot were half the amount produced by the control lot.

5. The trial lot preserved the yarn tensile strength better.

6. The trial lot produced better yarn quality, fewer slubs per pound.

7. Calculations showed that the use of this processing aid lowered production costs on the thousand pound trial lot by 5% as compared to the control lot.

EXAMPLE II 1,000 pounds of scoured wool stock intended for woolen system spinning was selected for use in this test. The test was carried out to demonstrate the advantages of the processing aid used in Example I above in the wool carbonizing bath to effect: gross improvements in fiber strength, softness, working properties, reduced waste, improved yarn strength, better efficiency through all subsequent processing.

Control Lot 500 pounds of the scoured stock was carbonized in the conventional way. The carbonizing bath was set at room temperature at a concentration of 8° Baume with sulfuric acid. Following impregnation with 8° Baume sulfuric acid, the stock was extracted and dried at 100° C followed by pulverizing and beating and then followed by neutralizing, washing, and drying. The purpose of carbonizing was to effect the disintegration and removal of all of the cellulosic material from the wool stock.

Trial Lot

The remaining 500 pound lot of the scoured stock was carbonized at room temperature in a bath having a concentration of 6° Baume sulfuric acid and 1% solids owf of the processing aid. The processing aid in the form of a 10% by weight solution was added to the carbonizing bath at the sinking trays as the stock was being fed from the hopper into the bath. Speeds of the machines and all the settings were identical to those used with the control lot.

After drying, the stock in the trial lot treated with the processing aid appeared to be much whiter, much freer of vegetable matter, and in a more open unentangled condition.

Processing Carding

These two 500 pound lots were each blended with 10% nylon and spun into a 1/14 count yarn. It was observed during carding that the control lot showed much more fly above the cards than the trial lot. This was the first indication of excessive fiber breakage in the control lot.

The web coming from the card prior to the tape condenser showed the trial lot was even and acceptable whereas the control lot showed the normal uneven, cloudy condition encountered with this type of carbonized stock.

Roving

A check of the roving coming from the tape condenser showed the end rovings of the control lot were within the ± 3% variation allowed from side to center, whereas the trial lot treated with the processing aid showed a deviation of less than ± 1-½%. A check of weight differences of yarn from the four spools of each card showed the control lot yarn to be ± 8% between spools whereas the trial lot showed a variation within ± 4%.

Spinning

In spinning, the control lot showed an efficiency of 224 breaks per 1,000 spindle hours which is considered a normal for this type stock but the trial lot showed an efficiency of a 164 breaks per 1,000 spindle hours.

Tensile Strength

Yarn takes from spinning: the control lot had an average breaking strength of 169 grams, while the trial lot treated with the processing aid had an average breaking strength of 198 grams. Increase in strength for the trial lot was 17%.

Waste

Overall waste through carding and spinning for the control lot was 24.3% and for the trial lot was 16.7%.

Quality

The evenness and character of woolen yarns are generally determined by a sereplane test which involves winding yarn from various spinning positions onto a board to observe uniformity, hairiness, and presence and identification of various types of slubs. Yarn from the control lot had the expected appearance and distribution of slubs. Yarn from the control lot had the expected appearance and distribution of slubs. The yarn from the trial lot was more uniform, had fewer thin places, and was noticeably less hairy in its appearance. Hairiness is generally attributed to the presence of excessive short fiber. This was a further indication that fiber carbonized in the presence of the processing aid was protected from the usual degradation and fiber breakage in processing.

EXAMPLE III

Example III demonstrates the application of the processing aid used in Example I in wool scouring, more particularly in the last rinse bath following scouring before the first drying. The scoured fiber was subsequently processed into tops and dyed with Fenachrome Black T as described in Example I. Since the processing aid had been previously applied in the scouring rinse, it was not necessary to pretreat with the processing aid and raise to the boil (as in Example I). Since it is desirable to reduce the dyeing time to the minimum possible time and the time at the boil as well as acid consumption, 0.2% solids of the processing aid on the weight of the fiber was added to the dye bath. The dye bath was then circulated through the tops packages prior to the addition of dyestuff along with 0.15% by weight nonionic surfactant. By this procedure, the total dyeing cycle for chrome black applied to tops was further reduced from the 115 minutes required for the control lot in Example I to a total dyeing cycle of 70 minutes. This time was less than half that normally required for the control lot in Example I.

This lot was composed of similar stock as used in Example I. Weight of the lot was 200 pounds.

| Tops Specifications | Accuracy |
|---|---|
| Specifications for the wool tops used were: | |
| WIRA length of fiber | 61.4 ± 6.4 mm |
| Variation Coefficient | 38 ± 4.5 |
| Percent of short fibers of maximum 36 mm length | 15.9 ± 8.8 |
| Number of large neps per kilo | 3.7 ± 2 |
| Number of small neps per kilo | 523 ± 105 |
| Number of large straws per kilo | 30.1 ± 12 |
| Number of small straws per kilo | 127 ± 38 |
| Number of loose slubs per kilo | 14 ± 5.5 |
| % Fatty matter owf | 0.31 ± 0.11 |
| Fineness | 24.2 Microns |

Dyeing

The scouring procedure was the same as used in Example I. The pretreatment was also the same as described in Example I, that is, 0.2% by weight of solids of the processing aid for five minutes at 40° C. The dyeing was carried out using the addition of 0.15% by weight of detergent based on the weight of the fiber. The dyeing cycle was begun at 40° C pH 7. Dyestuff was 3.6% Fenachrome Black T 200%.

Observations

There appeared to be no gross differences in the exhaustion rates from those observed with the processing aid dyeing in Example I. The shade and exhaustion were the same. The percentages of acid employed were the same and the bath exhausted in the same manner as in Example I. Somewhat less shrinkage of the top packages estimated by measurements before and after dyeing were noted. Shrinkage was approximately 15% less than the treated packages in Example I and approximately 20% less than the control packages in Example I. Back washing conditions were the same as in Example I. After dyeing, a check of yarn faults attributable to dyeing were as follows: slubs per kilo — 0; neps per kilo — 10.8; loose slubs per kilo — 16.7; fatty matter (rapid extraction petroleum ether) was 0.39.

Comb Blending

After gill mixing, this lot showed a uster evenness of 3.6 with an irregularity index of 8.77.

Drawing and Spinning Steps

1. In the auto leveler, gilling the lot processed much the same as the treated lot in Example I.
2. At the intersector drafter, the fiber processed normally at 78 meters per minute with a sliver weight of 15 grains per meter at a draft of 1–10.
3. At the intersector pin drafter at a speed of 94 meters per minute, the lot processed normally.
4. At the rover, at 60 meters per minute, the lot processed normally.

Waste collected from steps 1 + 2 + 3 + 4 for this example was 1.5% compared to the trial lot in Example I of 1.7%. The uster values and the irregularity indices of the slivers from the various preceding operations were as follows:

(a) Auto leveler gill: uster 2.25; irregularity index 6.1
(b) Intersector pin drafter: 2.67; irregularity index 4.8
(c) Intersector pin drafter: 3.2; irregularity index 5.61
(d) Rover: uster 4.4; irregularity index 2.2
(e) Spinning: the number of breaks per spindle hour in this trial (at a speed of 14 meters per minute 6,000 rpm) were 388. When the working speed was reduced to 12.5 meters per minute, the number of breaks per thousand spindle hours dropped to 218. Yarn properties of the trial lot were: yarn tensile strength in grains average: 145.2; yarn tensile strength in kilograms: 4.7; elongation: 5.1%; uster %: 15.2.

| Yarn Quality Per Kilo | |
|---|---|
| Number of end breaks originated by slubs | 97 |
| Number of end breaks originated by thin places | 10 |
| Number of end breaks originated by thick places | 4 |
| Total number of end breaks | 111 |

Yarn quality favorably favourably to results with trial lot treated with processing aid in Example I and was considerably better than the control lot in Example I, that is, a total of 111 breaks as compared to 308 breaks.

EXAMPLE IV

Increase in dye strike and rate of dyeing as evidenced by the increase in color strength over the control permit reductions in the concentration of acid used in the dyeing and the dyeing time at the boil.

This example demonstrates the increase in dye strike and the rate of dyeing obtained by pretreatment with various processing aids including the processing aid used in Example I when compared to the control where a processing aid was not used.

Samples of wool fabric were pretreated and dyed using the following procedures.

| Pretreatment with Processing Aid |
|---|
| Wool fabric: scoured worsted flannel. |
| Bath ratio 20 to 1. |
| Processing aid: 1% solids owf plus 0.2% nonionic surfactant owf. |
| Start pretreatment at 40° C. |
| Raise bath to boil in 20 minutes. |
| Drop bath. |
| Dyeing |
| Set dye bath with 0.2% nonionic surfactant |
| 1% sulfuric acid |
| 0.5% Acid Blue dye #45 (C.I. 63010) |
| Raise bath to boil in 20 minutes - stop dyeing. |

The above procedures were used to pretreat samples of wool fabric with each of the processing aids shown in the table below and to dye the pretreated samples to obtain the color strengths shown in the table. A color strength of 100% was obtained with the control which was not pretreated with a processing aid. This determination was made by the Kollmorgan KCS 18 Color Eye Computer on processing aid N below and all others were rated visually on this basis.

| Processing Aid | % Color Strength | Remarks |
|---|---|---|
| Con- | 100 | |

-continued

| Processing Aid | % Color Strength | Remarks |
|---|---|---|
| trol | | |
| A | 105 | a polyacrylamide having a molecular weight of 1-2 million |
| B | 118 | a chain extended polyamide prepared from 1 mole dimethyl glutarate with 0.9 mole diethylenetriamine terminated wth dimethylaminopropylamine chain extended with dichloroethylether |
| C | 107 | reaction product of acrylamide, diallyldimethyl ammonium chloride and glyoxal (Parez 630) |
| D | 116 | epoxidized polyethylenimine |
| E | 109 | epoxidized polyamide derived from adipic acid, diethylenetriamine and epichlorohydrin (Hercosett 57) |
| F | 115 | epoxidized bishexamethylenetriamine |
| G | 111 | epoxidized chain extended polyamide prepared from one mole adipic acid, with 0.9 mole diethylenetriamine terminated with dimethylaminopropylamine, chain extended with dichloroethylether and epoxidized with epichlorohydrin |
| H | 110 | chain extended polyamide prepared from one mole adipic acid with 0.9 mole diethylenetriamine terminated with dimethylaminopropylamine chain extended with dichloroether |
| I | 106 | sodium polyacrylate, low molecular weight, 40% solution Brookfield viscosity 2500-3000 cps. |
| J | 112 | epoxidized polyamide prepared from succinic acid and with diethylenetriamine terminated with dimethylaminopropylamine epoxidized with epichlorohydrin |
| K | 113 | epoxidized chain extended polyamide derived from Processing Aid B and epichlorohydrin |
| M | 119 | oligomer of one mole of dimethylaminopropylamine, 0.5 mole of urea and 0.5 mole of dichloroethyl ether |
| N | 141 | aminoplast resin from one mole of dicyandiamide, 0.5 mole of urea and 2.8 moles of formaldehyde |
| O | 117 | epoxidized polyamide prepared from Processing Aid B (above) and epichlorohydrin |
| P | 108 | epoxidized chain extended polyamide from suberic acid, and diethylene triamine, terminated with dimethylaminopropylamine, chain extended with dichloroethyl ether and epoxidized with epichlorohydrin |

EXAMPLE V

This example demonstrates the increase in dye strike and the rate of dyeing obtained by pretreatment with the various processing aids described in Example IV and drying to simulate application of the processing aids in the final scour rinse followed by drying and then dyeing the dried pretreated fabric. Samples of wool worsted fabric were run for 10 minutes in tap water at 40° C with sufficient of each of the processing aids shown in the table below to obtain a pickup of 1% solids owf. The samples were dried and then dyed using the dyeing procedure given in Example I to obtain the results shown in the table below. Increase in dye strike and rate of dyeing as evidenced by the increase in color strength over the control permit reductions in the concentration of acid used in the dyeing and the dyeing time at the boil.

| Processing Aid | % Color Strength |
|---|---|
| Control | 100 |
| D | 116 |
| C | 113 |
| I | 112 |
| A | 111 |
| M | 110 |
| F | 107 |

-continued

| Processing Aid | % Color Strength |
|---|---|
| N | 104 |

While the invention has been described with reference to certain specific embodiments thereof, it is understood that it is not to be so limited since alterations and changes may be made therein which are within the full and intended scope of the appended claims.

What is claimed is:

1. In a process for producing worsted from wool stock including the steps of rinsing the stock and dyeing tops, the improvement comprising pretreating the tops in a bath having a pH of about 6 prior to dyeing with a processing aid in an amount sufficient to preserve fiber strength and softness selected from the group consisting of (1) polyamide
(2) epoxidized polyamide
(3) chain extended polyamide
(4) epoxidized chain extended polyamide
(5) epoxidized polyamine
(6) epoxidized polyalkylenimine
(7) polyacrylamide
(8) polyacrylic acid
(9) aminoplast resin
(10) oligomer of urea, polyamine and alkylene dihalide, and
(11) reaction product of acrylamide, diallyldimethyl ammonium chloride and glyoxal wherein the polyamide is chain extended with a chain extender selected from the group consisting of alkyldihalide, alkyletherdihalide, phenyl bis-(alkylhalide), and phenylalkyldihalide having from one to twelve carbon atoms.

2. The process of claim 1 comprising additionally introducing in the bath in the rinsing step the processing aid in an amount sufficient to preserve fiber strength and softness.

3. The process of claim 1 wherein from about 0.2% to about 1.5% solids owf of the processing aid is used.

4. The process of claim 2 wherein from about 0.2% to about 1.5% solids owf of the processing aid is used.

5. The process of claim 3 wherein the processing aid is an epoxidized chain extended polyamide.

6. The process of claim 4 wherein the processing aid is an epoxidized chain extended polyamide.

7. The process of claim 5 wherein the epoxidized chain extended polyamide is derived from a carboxylic acid terminated polyamide which is the reaction product of a saturated dicarboxylic acid having from 4 to 12 carbon atoms or as ester thereof and a polyamine present in about 0.66 to about 0.99 moles per mole of the acid, reacted with a terminating polyamine in an amount at least sufficient to react with all free carboxylic acid groups to form a terminated base, the terminated base reacted with a chain extender in about equimolar quantities to form a chain extended base and the chain extended base in turn reacted with from about 0.6 to about 1.5 moles of an epoxidizing agent per unreacted secondary or tertiary amino group.

8. The process of claim 6 wherein the epoxidized chain extended polyamide is derived from a carboxylic acid terminated polyamide which is the reaction product of a saturated dicarboxylic acid having from 4 to 12 carbon atoms or an ester thereof and a polyamine present in about 0.66 to about 0.99 moles per mole of the acid, reacted with a terminating polyamine in an amount at least sufficient to react with all free carboxylic acid groups to form a terminated base, the terminated base reacted with a chain extender in about equimolar quantities to form a chain extended base and the chain extended base in turn reacted with from about 0.6 to about 1.5 moles of an epoxidizing agent per unreacted secondary or tertiary amino group.

9. In a process for producing woolen from wool stock including the steps of rinsing and carbonizing, the improvement comprising introducing in the carbonizing bath having a concentration of about 6° Baume sulfuric acid, in the rinsing step or both, a processing aid in an amount sufficient to produce whiter, cleaner fiber and to preserve fiber strength selected from the group consisting of (1) polyamide
(2) epoxidized polyamide
(3) chain extended polyamide
(4) epoxidized chain extended polyamide
(5) epoxidized polyamine
(6) epoxidized polyalkylenimine
(7) polyacrylamide
(8) polyacrylic acid
(9) aminoplast resin
(10) oligomer of urea, polyamine and alkylene dihalide, and
(11) reaction product of acrylamide, diallyldimethyl ammonium chloride and glyoxal wherein the polyamide is chain extended with a chain extender selected from the group consisting of alkyldihalide, alkyletherdihalide, phenyl bis-(alkylhalide), and phenylalkyldihalide having from one to twelve carbon atoms.

10. The process of claim 9 wherein the processing aid is introduced into the carbonizing step, in an amount sufficient to produce whiter, cleaner fiber and to preserve fiber strength.

11. The process of claim 9 wherein from about 0.2% to about 1.5% solids owf of the processing aid is used.

12. The process of claim 9 wherein the processing aid is introduced into the rinsing step, in an amount sufficient to produce whiter, cleaner fiber and to preserve fiber strength.

13. The process of claim 10 wherein from about 0.2% to about 1.5% solids owf of the processing aid is used.

14. The process of claim 9 wherein the processing aid is an epoxidized chain extended polyamide.

15. The process of claim 10 wherein the processing aid is an epoxidized chain extended polyamide.

16. The process of claim 14 wherein the epoxidized chain extended polyamide is derived from a carboxylic acid terminated polyamide which is the reaction product of a saturated dicarboxylic acid having from 4 to 12 carbon atoms or an ester thereof and a polyamine present in about 0.66 to about 0.99 moles per mole of the acid, reacted with a terminating polyamine in an amount at least sufficient to react with all free carboxylic acid groups to form a terminated base, the terminated base reacted with a chain extender in about equimolar quantities to form a chain extended base and the chain extended base in turn reacted with from about 0.6 to about 1.5 moles of an epoxidizing agent per unreacted secondary or tertiary amino group.

17. The process of claim 15, wherein the epoxidized chain extended polyamide is derived from a carboxylic acid terminated polyamide which is the reaction product of a saturated dicarboxylic acid having from 4 t0 12 carbon atoms or an ester thereof and a polyamine present in about 0.66 to about 0.99 moles per mole of the acid, reacted with a terminating polyamine in an amount at least sufficient to react with all free carboxylic acid groups to form a terminated base, the terminated base reacted with a chain extender in about equimolar quantities to form a chain extended base and the chain extended base in turn reacted with from about 0.6 to about 1.5 moles of an epoxidizing agent per unreacted secondary or tertiary amino group.

18. In the process of claim 1 for producing worsted from wool stock including the steps of rinsing the stock and dyeing tops, the improvement comprising pretreating the tops prior to dyeing with a processing aid in an amount sufficient to preserve fiber strength and softness selected from the group consisting of epoxidized polyamide and epoxidized chain extended polyamide wherein the polyamide is chain extended with a chain extender selected from the group consisting of alkyldihalide, alkyletherdihalide, phenyl bis-(alkylhalide), and phenylalkyldihalide having from one to twelve carbon atoms.

19. The process of claim 18 comprising additionally introducing in the bath in the rinsing step the processing aid in an amount sufficient to preserve fiber strength and softness.

20. The process of claim 18 wherein from about 0.2% to about 1.5% solids owf of the processing aid is used.

21. The process of claim 19 wherein from about 0.2% to about 1.5% solids owf of the processing aid is used.

22. In the process of claim 9 for producing woolen from wool stock including the steps of rinsing and carbonizing, the improvement comprising introducing in the carbonizing bath, in the rinsing step or both, a processing aid in an amount sufficient to produce whiter, cleaner fiber and to preserve fiber strength selected from the group consisting of epoxidized polyamide and epoxidized chain extended polyamide wherein the polyamide is chain extended with a chain extender selected from the group consisting of alkyldihalide, alkyletherdihalide, phenyl bis-(alkylhalide), and phenylalkyldihalide having from one to twelve carbon atoms.

23. The process of claim 22 wherein the processing aid is introduced into the carbonizing step, in an amount sufficient to produce whiter, cleaner fiber and to preserve fiber strength.

24. The process of claim 22 wherein from about 0.2% to about 1.5% solids owf of the processing aid is used.

25. The process of claim 22 wherein the processing aid is introduced into the rinsing step, in an amount sufficient to produce whiter, cleaner fiber and to preserve fiber strength.

26. The process of claim 23 wherein from about 0.2% to about 1.5% solids owf of the processing aid is used.

27. The process of claim 1 wherein the epoxidized chain extended polyamide is derived from a carboxylic acid terminated polyamide which is the reaction product of adipic acid or an ester thereof and diethylenetriamine present in about 0.66 to about 0.99 moles per mole of the acid, reacted with dimethylaminopropylamine in an amount at least sufficient to react with all free carboxylic acid groups to form a terminated base, the terminated base reacted with dichloroethyl ether in about equimolar quantities to form a chain extended base and the chain extended base in turn reacted with from about 0.6 to about 1.5 moles of epichlorohydrin per unreacted secondary or tertiary amino group.

28. The process of claim 1 wherein the chain extender is an alkyletherdihalide.

29. The process of claim 1 wherein the chain extender is dichloroethyl ether.

30. The process of claim 9 wherein the epoxidized chain extended polyamide is derived from a carboxylic acid terminated polyamide which is the reaction product of adipic acid or an ester thereof and diethylenetriamine present in about 0.66 to about 0.99 moles per mole of the acid, reacted with dimethylaminopropylamine in an amount at least sufficient to react with all free carboxylic acid groups to form a terminated base, the terminated base reacted with dichloroethyl ether in about equimolar quantities to form a chain extended base and the chain extended base in turn reacted with from about 0.6 to about 1.5 moles of epichlorohydrin per unreacted secondary or tertiary amino group.

31. The process of claim 9 wherein the chain extender is an alkyletherdihalide.

32. The process of claim 9 wherein the chain extender is dichloroethyl ether.

* * * * *